US012377939B2

(12) United States Patent
Huang et al.

(10) Patent No.: US 12,377,939 B2
(45) Date of Patent: Aug. 5, 2025

(54) MULTI-AIR-CHAMBER SURFBOARD

(71) Applicant: BESTWAY INFLATABLES & MATERIAL CORP., Shanghai (CN)

(72) Inventors: Shuiyong Huang, Shanghai (CN); Qingshui Song, Shanghai (CN); Hongxing Zhang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 24 days.

(21) Appl. No.: 17/469,130

(22) Filed: Sep. 8, 2021

(65) Prior Publication Data

US 2022/0081077 A1 Mar. 17, 2022

(30) Foreign Application Priority Data

Sep. 16, 2020 (CN) ..... 202022025278.8

(51) Int. Cl.

| | |
|---|---|
| ***B63B 32/51*** | (2020.01) |
| ***B63B 7/08*** | (2020.01) |
| ***B63B 32/53*** | (2020.01) |
| *B63B 32/40* | (2020.01) |

(52) U.S. Cl.

CPC ..... *B63B 32/51* (2020.02); *B63B 7/08* (2013.01); *B63B 32/53* (2020.02); *B63B 32/40* (2020.02)

(58) Field of Classification Search

CPC ..... B63B 32/00; B63B 32/51; B63B 32/53; B63B 7/00; B63B 7/08; B63B 35/00; B63B 35/79

USPC ..... 441/75, 64

See application file for complete search history.

(56) References Cited

U.S. PATENT DOCUMENTS

| | | | | |
|---|---|---|---|---|
| 10,913,518 | B2 * | 2/2021 | Prade | B63B 32/51 |
| 11,247,750 | B2 * | 2/2022 | Lin | B63B 7/08 |
| 2013/0137319 | A1 | 5/2013 | Halyer et al. | |
| 2022/0081077 | A1 | 3/2022 | Huang | |

FOREIGN PATENT DOCUMENTS

| | | |
|---|---|---|
| CN | 103264762 | 8/2013 |
| CN | 203345172 | 12/2013 |
| CN | 203345174 | 12/2013 |
| CN | 203428004 | 2/2014 |

(Continued)

OTHER PUBLICATIONS

Double Chamber Technology, safer.stiffer.better, Sep. 28, 2018 (Sep. 28, 2018), XP055630915, Retrieved from the Internet: URL:HTPPS://web.archive.org/web/20180928144223/http;//www.aztronsports.com/technology/double_chamber.html [retrived on Oct. 10, 2019].

(Continued)

*Primary Examiner* — Lars A Olson

(74) *Attorney, Agent, or Firm* — DICKINSON WRIGHT PLLC

(57) ABSTRACT

A surfboard is provided, which may include a first air chamber, a second air chamber, and a partition arranged between the first air chamber and the second air chamber. The partition may comprise: a first connecting portion connected to a top wall of the first air chamber and to a top wall of the second air chamber; a second connecting portion connected to a bottom wall of the first air chamber and to a bottom wall of the second air chamber; and an intermediate portion extending between the first connecting portion and the second connecting portion.

37 Claims, 8 Drawing Sheets

(56) References Cited

FOREIGN PATENT DOCUMENTS

| | | |
|---|---|---|
| CN | 210971448 | 7/2020 |
| DE | 202020104257 | 7/2020 |
| EP | 2808245 | 12/2014 |
| EP | 3689735 | 8/2020 |
| KR | 20150007580 | 1/2015 |

OTHER PUBLICATIONS

Extended European Search Report dated Feb. 15, 2022 (Feb. 15, 2022) issued on related European patent application EP21196112.3 by the European Patent Office.

* cited by examiner

MULTI-AIR-CHAMBER SURFBOARD

CROSS-REFERENCE TO RELATED APPLICATION

This Application claims priority from Chinese Application CN202022025278.8, filed Sep. 16, 2020, in China, the disclosure of which is incorporated herein by reference in its entirety.

BACKGROUND

1. Field

Apparatuses and methods consistent with example embodiments relate to floating structures for entertainment or sports, and in particular, to a multi-air-chamber surfboard.

2. Description of the Related Art

Related art surfboards are often large and cannot be folded, and as such, are inconvenient to carry. Inflatable surfboards are becoming increasingly popular because they can be deflated, folded, and then placed, when not in use, for example, in a backpack. However, existing inflatable surfboards may have only one air chamber, and if air leakage occurs when the air chamber becomes cracked when in use, a surfer may drown due to being unable to swim back to the shore without the assistance of a flotation device.

SUMMARY

Example embodiments may address at least the above problems and/or disadvantages and other disadvantages not described above. Also, example embodiments are not required to overcome the disadvantages described above, and may not overcome any of the problems described above.

One or more example embodiments may provide a multi-air-chamber surfboard, and, according to one or more example embodiments, air chambers of the multi-air-chamber surfboard may be independent from each other.

According to an aspect of an example embodiment, a surfboard is provided, the surfboard comprising: at least a first air chamber and a second air chamber; and a partition arranged between the first air chamber and the second air chamber, the partition comprising: a first connecting portion connected to a top wall of the first air chamber and to a top wall of the second air chamber; a second connecting portion connected to a bottom wall of the first air chamber and to a bottom wall of the second air chamber; and an intermediate portion extending between the first connecting portion and the second connecting portion.

The intermediate portion may consist of only a single, integral piece of material.

The intermediate portion may separate the first air chamber from the second air chamber, and be integrally formed with at least one of the first connecting portion and the second connecting portion.

The intermediate portion may be connected to the first connecting portion and to the second connecting portion.

The first connecting portion may comprise two top wall connecting pieces, each comprising an extension piece extending between the first air chamber and the second air chamber. The second connecting portion may comprise two bottom wall connecting pieces, each comprising an extension piece extending between the first air chamber and the second air chamber.

The intermediate portion may be integrally formed with the extension pieces of at least one of the first connecting portion and the second connecting portion.

The intermediate portion may be connected to the extension pieces of the first connecting portion and the second connecting portion by at least one of high-frequency welding, hot melting, and gluing.

The surfboard may further comprise a reinforcing piece disposed on and covering one of the first connecting portion and the second connecting portion.

The second air chamber may be arranged around the first air chamber, and the reinforcing piece may comprise an annular reinforcing piece surrounding and covering the one of the first connecting portion and the second connecting portion.

The second air chamber may be arranged around the first air chamber, and the reinforcing piece may comprise a planar reinforcing piece covering at least one of the first air chamber and the second air chamber and covering the one of the first connecting portion and the second connecting portion.

The surfboard may further comprise an auxiliary reinforcing piece arranged between the reinforcing piece and the one of the first connecting portion and the second connecting portion, the auxiliary reinforcing piece surrounding and covering the one of the first connecting portion and the second connecting portion.

At least one of the reinforcing piece and the auxiliary reinforcing piece may be connected to another element by at least one of high-frequency welding, hot melting, and gluing.

The first air chamber may comprise a first air valve, and the second air chamber may comprise a second an air valve.

Each of the first air chamber and the second air chamber may comprise a drop-stitch material.

According to an aspect of another example embodiment, an inflatable device is provided, the inflatable device comprising: a first air chamber partially enclosed by a first top wall and a first bottom wall; a second air chamber partially enclosed by a second top wall and a second bottom wall; and a partition arranged between the first air chamber and the second air chamber, the partition comprising: a first connecting portion connected to the first top wall and the second top wall, a second connecting portion connected to the first bottom wall and the second bottom wall, and an intermediate portion extending between the first connecting portion and the second connecting portion.

The inflatable device may further comprise: a top reinforcing piece disposed on the first connecting portion; and a bottom reinforcing piece disposed on the second connecting portion.

The top reinforcing piece may be disposed on and cover at least a portion of the first top wall and an entirety of the second top wall; and the bottom reinforcing piece may be disposed on and cover at least a portion of the first bottom wall and an entirety of the second bottom wall.

The inflatable device may further comprise: an auxiliary top reinforcing piece disposed on and covering the top reinforcing piece; and an auxiliary bottom reinforcing piece disposed on and covering the bottom reinforcing piece.

The auxiliary top reinforcing piece may be disposed on and covers at least a portion of the first top wall and an entirety of the second top wall; and the auxiliary bottom reinforcing piece may be disposed on and covers at least a portion of the first bottom wall and an entirety of the second bottom wall.

The first connecting portion may comprise two top wall connecting pieces respectively connected to the first top wall and the second top wall; the second connecting portion may comprise two top wall connecting pieces respectively connected to the first bottom wall and the second bottom wall; a top edge of the intermediate portion may be sandwiched between the two top wall connecting pieces; and a bottom edge of the intermediate portion may be sandwiched between the two bottom wall connecting pieces.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
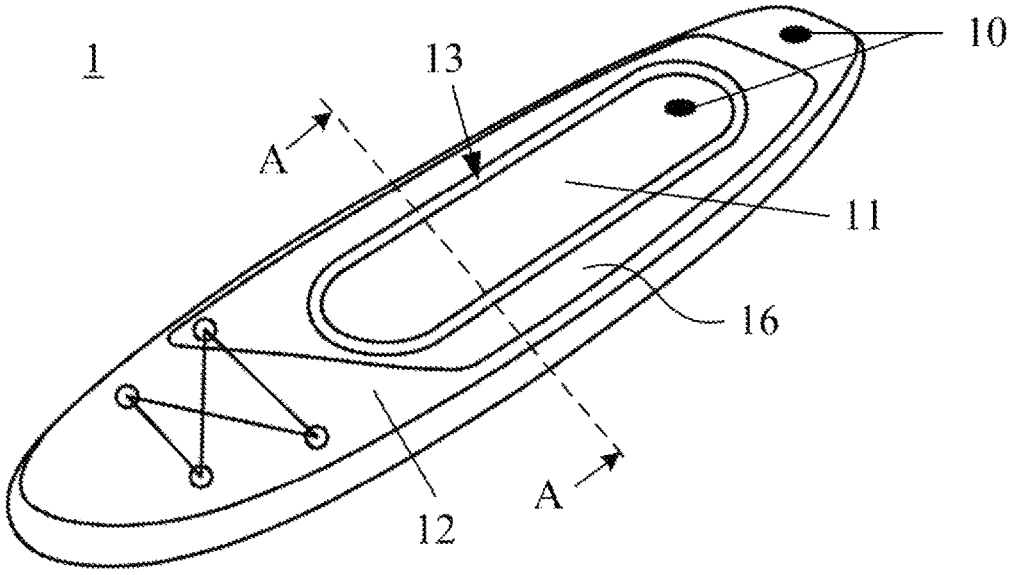
FIG. 1 is a schematic perspective view of a surfboard of an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise", and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," and "upper," "lower," "inside," "outside," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these exemplary embodiments pertain may not be described here in detail.

The implementation and application of example embodiments will be discussed in detail below.

A surfboard according to one or more example embodiments may comprise a surfboard, a stand-up paddle board, a pair of water skis, or another recreational flotation device.

FIGS. 1 to 5 show a surfboard 1 of an exemplary embodiment. As shown in FIG. 1, the surfboard 1 is a double-air-chamber surfboard, comprising a first air chamber 11 and a second air chamber 12, where the first and second air chambers are independent from each other. The second air chamber 12 is arranged around the first air chamber 11, the first air chamber 11 and the second air chamber 12 are each provided with an air valve 10, and a partition 13 is arranged between the first air chamber 11 and the second air chamber 12.

Figure 2A:
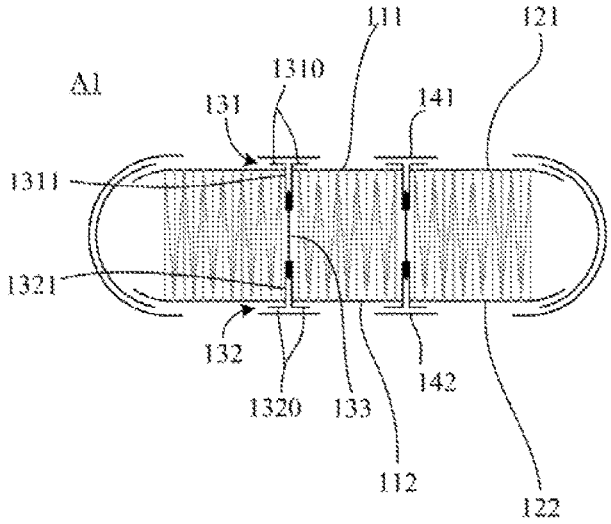
FIG. 2*a* is a schematic cross-sectional view of an example embodiment A1 taken along a line A-A in FIG. 1.
Figure 2B:
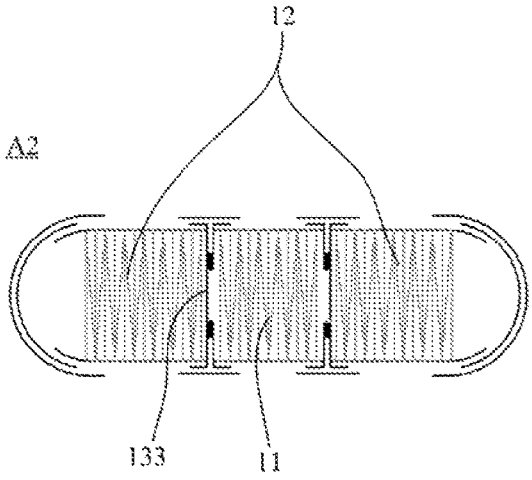
FIG. 2*b* is a schematic cross-sectional view of another example embodiment A2 taken along the line A-A in FIG. 1.

FIGS. 2*a* and 2*b* illustrate two example embodiments A1, A2 of a cross-section taken along a line A-A in FIG. 1. According to example embodiment A1, as shown in FIG. 2*a*, the partition 13 comprises a first connecting portion 131, a second connecting portion 132, and an intermediate portion 133. The first connecting portion 131 comprises a pair of top wall connecting pieces 1310, which may be symmetrically-arranged. The pair of top wall connecting pieces 1310 are respectively connected to a top wall 111 of the first air chamber 11 and a top wall 121 of the second air chamber 12. The second connecting portion 132 comprises a pair of bottom wall connecting pieces 1320, which may be symmetrically-arranged. The pair of bottom wall connecting pieces 1320 are each respectively connected to a bottom wall 112 of the first air chamber 11 and a bottom wall 122 of the second air chamber 12. The intermediate portion 133 may be formed of a single piece of material, such as, but not limited to, a single piece of polyvinyl chloride (PVC) material or a single piece of laminated PVC mesh material, which is connected to the first connecting portion 131 and the second connecting portion 132 respectively between the first air chamber 11 and the second air chamber 12. As shown in FIG. 2*a*, a pair of top wall connecting pieces 1310 may be integrally provided with top wall extension pieces 1311 extending between the first air chamber 11 and the second air chamber 12, and a pair of bottom wall connecting pieces 1320 may be integrally provided with bottom wall extension pieces 1321 extending between the first air chamber 11 and the second air chamber 12. That is, the portions of each of the top wall connecting pieces 1310 and the bottom wall connecting pieces 1320 connected to the first air chamber 11 and the second air chamber 12 may be arranged roughly transversely, and the top wall extension pieces 1311 of the top wall connecting pieces 1310 and the bottom wall extension pieces 1321 of the bottom wall connecting pieces 1320 may be arranged roughly vertically. One end of the intermediate portion 133 is sandwiched between a pair of top wall extension pieces 1311 and the other end is sandwiched between a pair of bottom wall extension pieces 1321. A manner in which the intermediate portion 133 is connected to the top wall extension pieces 1311 and/or the bottom wall extension pieces 1321 may include, but is not limited to high-frequency welding, hot melting, and/or gluing.

According to example embodiment A2, as shown in FIG. 2*b*, a difference between this example embodiment A2 and the example embodiment A1 is that the intermediate portion 133 of the example embodiment A2 may be integrally formed with the first connecting portion 131 and the second connecting portion 132 between the first air chamber 11 and the second air chamber 12. That is, one end of the intermediate portion 133 may be integrally formed with one top wall extension piece of the first connecting portion 131, and the other end of the intermediate portion 133 may be integrally formed with one bottom wall extension piece of the second connecting portion 132. Both ends of the intermediate portion 133 may be integrally formed with the top wall extension piece 1311 and the bottom wall extension piece 1321 on a same side of the first connecting portion 131 and the second connecting portion 132, respectively (as shown in the example embodiment of FIG. 2*b*). Alternately, although not shown, ends of the intermediate portion 133 may be integrally formed with the top wall extension piece 1311 and the bottom wall extension piece 1321 on the different sides of the first connecting portion 131 and the second connecting portion 132, respectively.

Alternately, though not illustrated in FIGS. 2*a* and 2*b*, the intermediate portion 133 may be arranged between the first air chamber 11 and the second air chamber 12 such that one end thereof is integrally formed with the top wall extension piece 1311 of one side of the first connecting portion 131, and the other end of the intermediate portion 133 is sandwiched between a pair of bottom wall extension pieces 1321 of the second connecting portion 132. Alternately, one end of the intermediate portion 133 may be sandwiched between a pair of top wall extension pieces 1311 of the first connecting portion 131, and the other end of the intermediate portion 133 may be integrally formed with the bottom wall extension piece 1321 of one side of the second connecting portion 132.

According to example embodiments A1 and A2, the first air chamber 11 and the second air chamber 12 may be separated by the intermediate portion 133, which may be made of a single piece of material and may be connected to each air chamber by means of the first connecting portion 131 and the second connecting portion 132.

Figure 3:
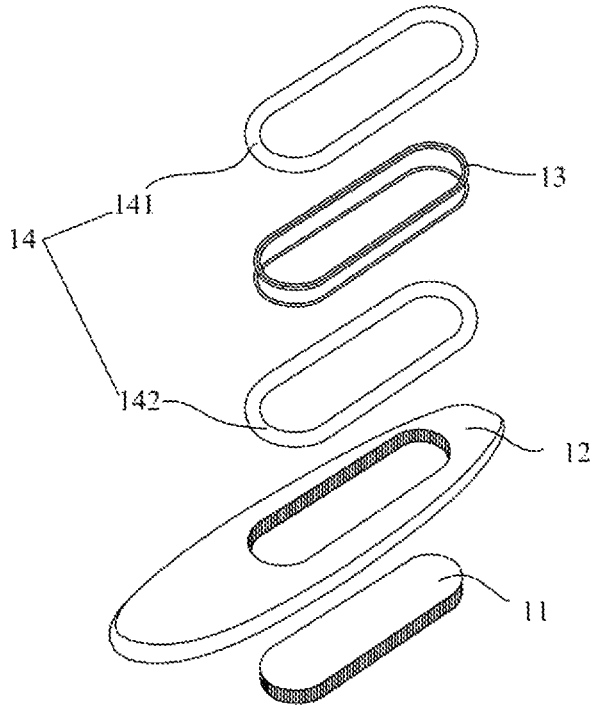
FIG. 3 is an exploded schematic view of a surfboard according to example embodiment A1 or A2.

FIG. 3 is an exploded schematic view of a surfboard according to example embodiment A1 or A2. Since the second air chamber 12 is arranged around the first air chamber 11, the partition 13, dividing the first and second chambers 11 and 12 from each other, is annular. The first air chamber 11 and the second air chamber 12 may both be made of a drop-stitch material, so the partition 13 serves to connect the first air chamber 11 and the second air chamber 12 and also serves to separate the first air chamber 11 from the second air chamber 12. As shown in the cross-sectional views of FIGS. 2*a* and 2*b*, the partition 13 may be symmetrically arranged on both sides of the first air chamber 11.

A double-air-chamber surfboard, as described for example in the above example embodiments, may be manufactured as described below.

According to an example embodiment of a manufacturing method, a drop-stitch material sheet, with the overall contour of the desired surfboard, may be cut from a larger piece of drop-stitch material. The overall contour of the cut portion may be the same as a desired an outer contour of the second air chamber 12. An inner portion is then cut from the cut material sheet, the inner portion having an outer contour corresponding to a desired shaped of the first air chamber 11, such that an opening matching the desired outer contour of the first air chamber 11 is formed in the middle of the drop-stitch material sheet with the overall contour, thereby forming a second drop-stitch material sheet.

The partition 13 may be made by connecting a single piece of strip-shaped material, such as a single piece of PVC material or a single piece of laminated PVC mesh material, end to end to form an annular intermediate portion 133. The annular intermediate portion 133 may be connected to the first connecting portion 131 and the second connecting portion 132 by high-frequency welding, hot melting, gluing, and or another connection method, The first connecting portion 131 of the partition 13 may be connected to the top wall 111 of the first drop-stitch material sheet having the outer contour of the desired first air chamber 11. The second connecting portion 132 of the partition 13 may be connected to the bottom wall 112 of the first drop-stitch material sheet having the outer contour of the desired first air chamber 11. That is, the first drop-stitch material sheet and the partition 13 are connected, forming the first air chamber 11.

The first connecting portion 131 of the partition 13 may be connected to the top wall 121 at a middle opening of the second drop-stitch material sheet having the outer contour of the desired second air chamber 12. The second connecting portion 132 of the partition 13 may be connected to the bottom wall 122 at the middle opening of the second drop-stitch material sheet having the outer contour of the second air chamber, such that the first drop-stitch material sheet having the outer contour of the first air chamber 11 is located at the middle opening of the second drop-stitch material sheet having the outer contour of the second air chamber 12, and the outer contour of the second drop-stitch material sheet is sealed by an edge sealing material. That is, the second drop-stitch material sheet, the partition 13, and the edge sealing material are connected, forming the second air chamber 12.

According to another example embodiment, as shown in FIG. 3, the surfboard 1 may further comprise a reinforcing piece 14, the reinforcing piece 14 comprising an annular top wall reinforcing piece 141 and an annular bottom wall reinforcing piece 142. As shown in conjunction with FIG. 2*a*, the top wall reinforcing piece 141 may cover the first connecting portion 131, and the bottom wall reinforcing piece 142 may cover the second connecting portion 132. The top wall reinforcing piece 141 may completely cover the first connecting portion 131 and be connected to the top walls of the first air chamber 11 and the second air chamber 12. The bottom wall reinforcing piece 142 may completely cover the second connecting portion 132 and be connected to the bottom walls of the first air chamber 11 and the second air chamber 12. Alternately, the top wall reinforcing piece 141 and the bottom wall reinforcing piece 142 may respectively cover only a portion of the first connecting portion 131 and the second connecting portion 132.

Figure 4A:
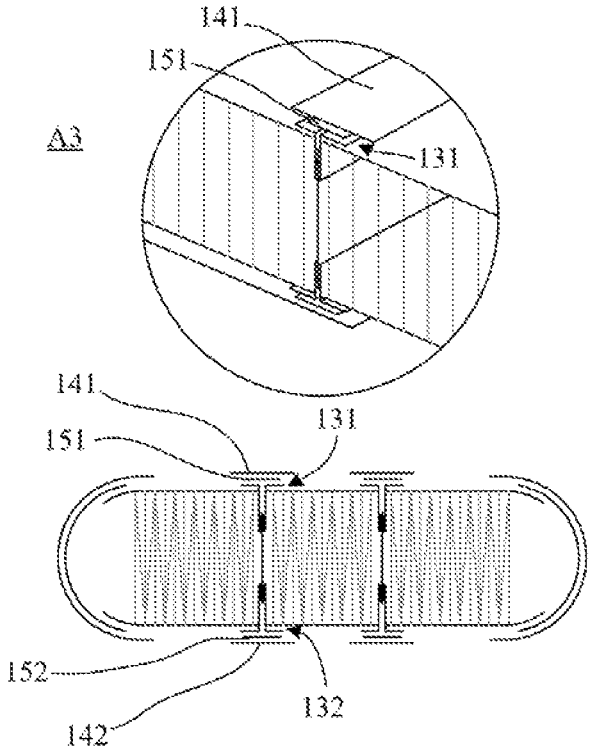
FIG. 4*a* is a schematic cross-sectional view, including an enlarged schematic view, of a further example embodiment A3 taken along the line A-A in FIG. 1.
Figure 4B:
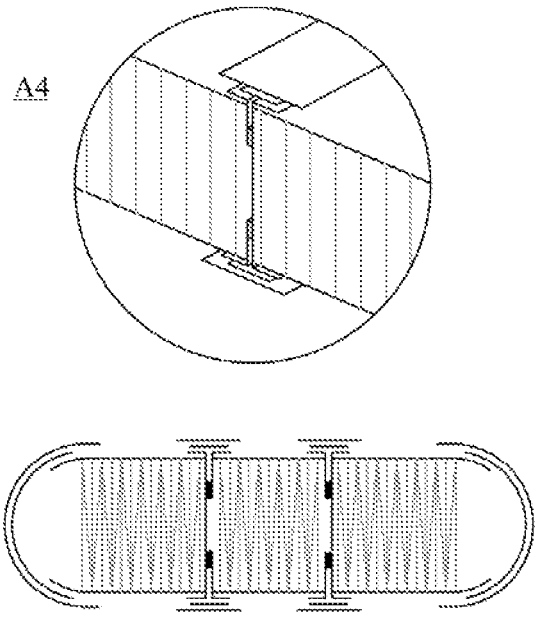
FIG. 4*b* is a schematic cross-sectional view, including an enlarged schematic view, of yet a further example embodiment A4 taken along the line A-A in FIG. 1.
Figure 5:
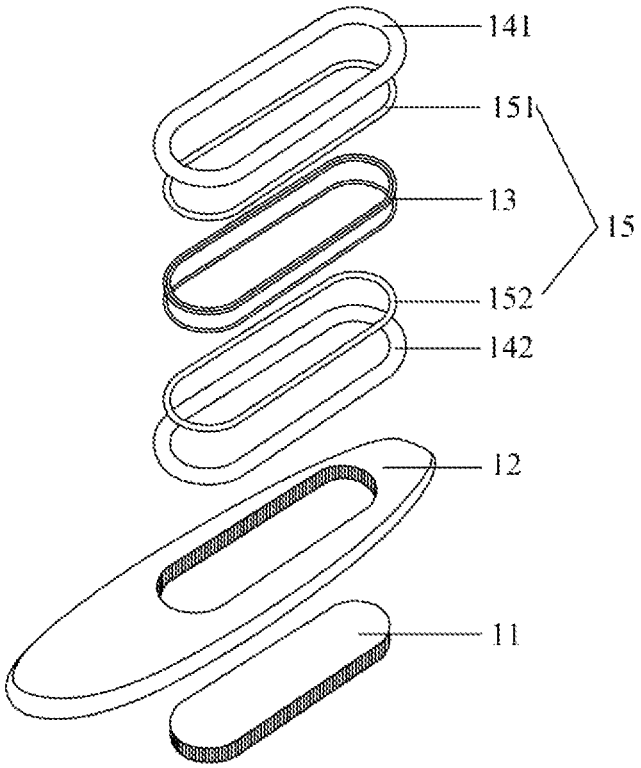
FIG. 5 is an exploded schematic view of a surfboard according to example embodiment A3 or A4.
Figure 6:
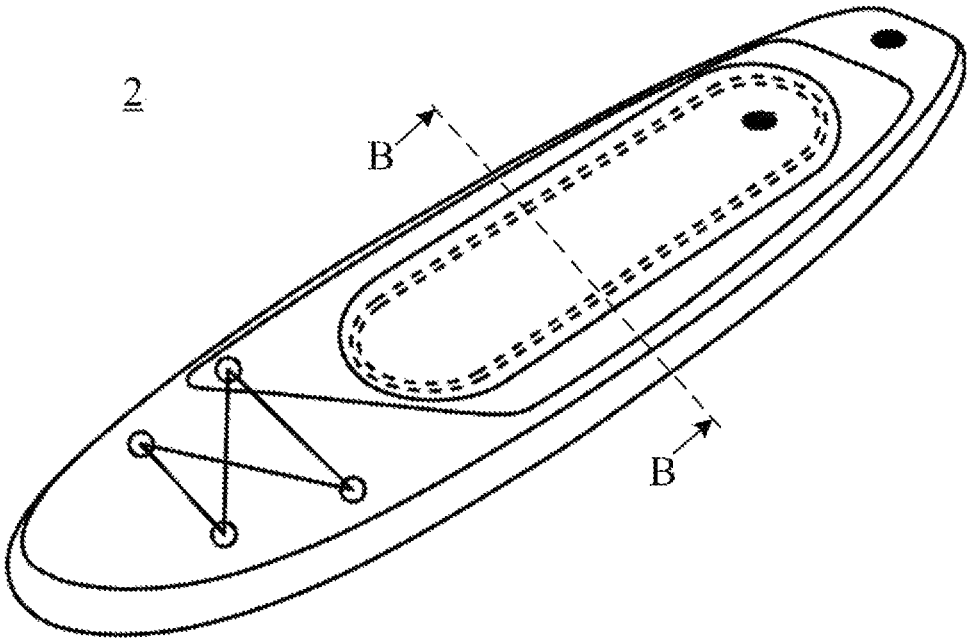
FIG. 6 shows a schematic perspective view of a surfboard of another example embodiment.

According to another example embodiment, the surfboard may further comprise an auxiliary reinforcing piece arranged between the reinforcing piece and the first connecting portion and/or between the reinforcing piece and the second connecting portion. As shown in FIGS. 4*a*, 4*b*, and 5, the surfboard 1 may comprise an auxiliary reinforcing piece 15 arranged between the reinforcing piece 14 and the partition 13. In particular, the auxiliary reinforcing piece 15 may comprise a top wall auxiliary reinforcing piece 151 and a bottom wall auxiliary reinforcing piece 152. The top wall auxiliary reinforcing piece 151 is arranged between the top wall reinforcing piece 141 and the first connecting portion 131, and the bottom wall auxiliary reinforcing piece 152 is arranged between the bottom wall reinforcing piece 142 and the second connecting portion 132. The top wall auxiliary reinforcing piece 151 and the bottom wall auxiliary reinforcing piece 152 may each have an annular structure, and the top wall auxiliary reinforcing piece 151 may cover a gap between a pair of top wall connecting pieces 1310 of the first connecting portion 131, and the bottom wall auxiliary reinforcing piece 152 may cover a gap between a pair of bottom wall connecting pieces 1320 of the second connecting portion 132. The auxiliary reinforcing piece 15 may comprise only one of the top wall auxiliary reinforcing piece 151 and the bottom wall auxiliary reinforcing piece 152.

Figure 7A:
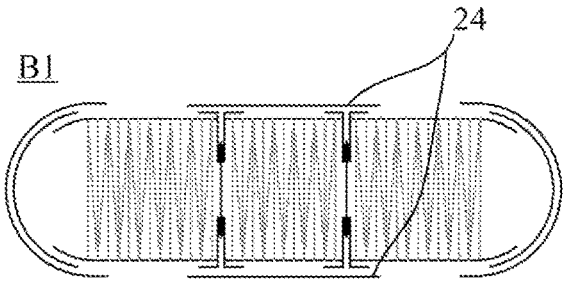
FIG. 7*a* is a schematic cross-sectional view of an example embodiment B1 taken along a line B-B in FIG. 6.
Figure 7B:
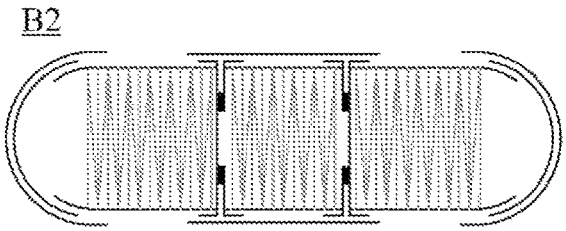
FIG. 7*b* is a schematic cross-sectional view of another example embodiment B2 taken along the line B-B in FIG. 6.
Figure 8:
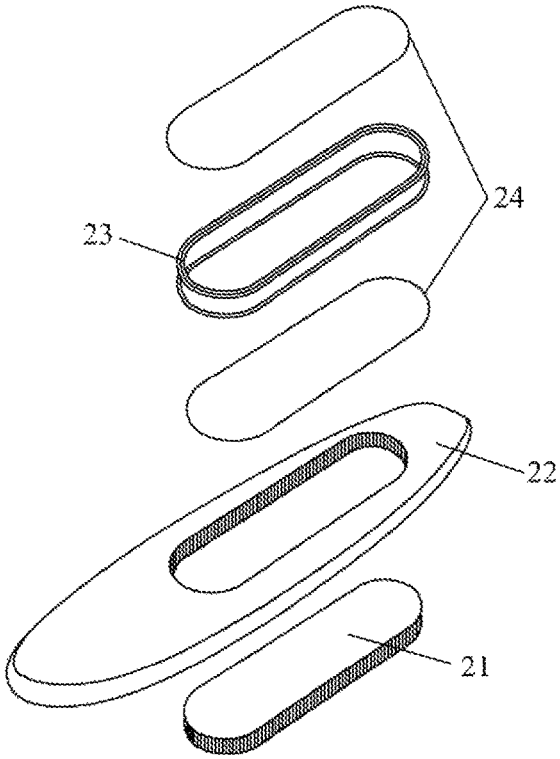
FIG. 8 is an exploded schematic view of a surfboard according to example embodiment B1 or B2.
Figure 9A:
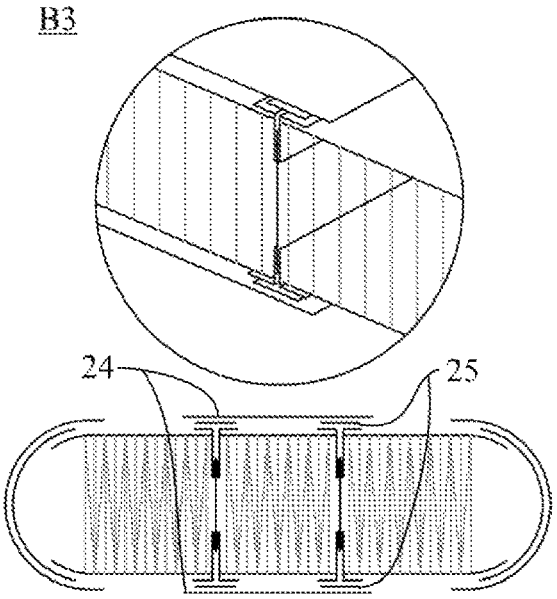
FIG. 9*a* is a schematic cross-sectional view, including an enlarged schematic view, of a further example embodiment B3 taken along the line B-B in FIG. 6.
Figure 9B:
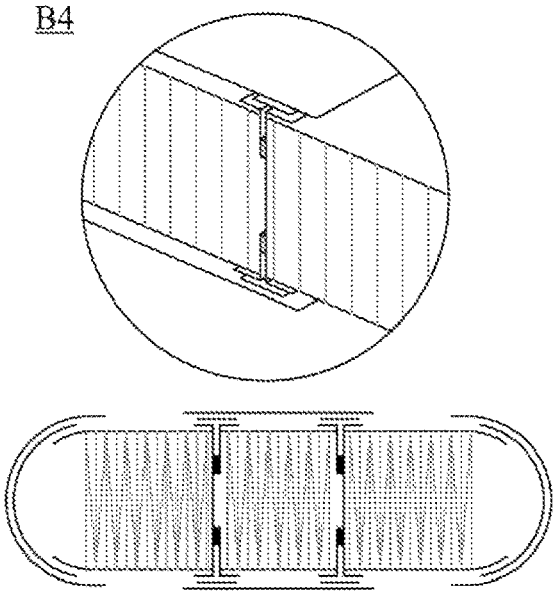
FIG. 9*b* is a schematic cross-sectional view, including an enlarged schematic view, of yet a further example embodiment B4 taken along the line B-B in FIG. 6.
Figure 10:
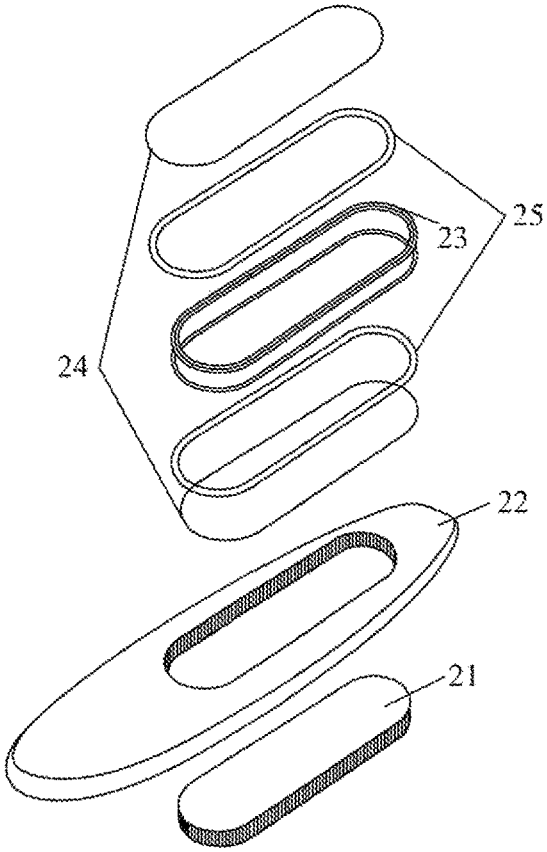
FIG. 10 is an exploded schematic view of a surfboard according to example embodiment B3 or B4.
Figure 11:
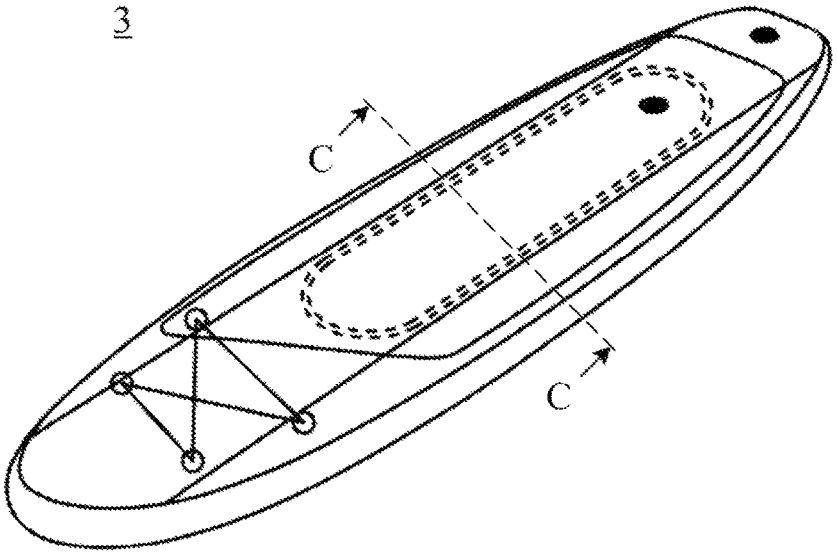
FIG. 11 shows a schematic perspective view of a surfboard of a further example embodiment.

FIGS. 6 to 10 illustrate a surfboard 2 of another example embodiment, the surfboard 2 also having a double-air-chamber structure. In the drawings, FIGS. 7*a*, 7*b*, 9*a* and 9*b* show cross-sectional views of different example embodiments B1 to B4, respectively, of the section of the surfboard 2 taken along a line B-B. FIGS. 7*a* to 8 show a surfboard having a reinforcing piece 24, and FIGS. 9*a* to 10 show a surfboard with a reinforcing piece 24 and an auxiliary reinforcing piece 25. The difference between the reinforcing piece and the reinforcing piece 14 of the above-described example embodiment is that the reinforcing piece 24 of this example embodiment is substantially planar and may cover not only the partition 23 but also the first air chamber 21 of the surfboard 2. The auxiliary reinforcing piece 25 is arranged between the reinforcing piece 24 and the partition 23, and the auxiliary reinforcing piece 25 may be configured similarly to the auxiliary reinforcing piece 15 of the example embodiment shown in FIGS. 4 to 5. The partition 23 may be analogous to the partition 13, such as that shown in FIGS. 7*a*, 7*b*, 9*a* and 9*b*.

Figure 12A:
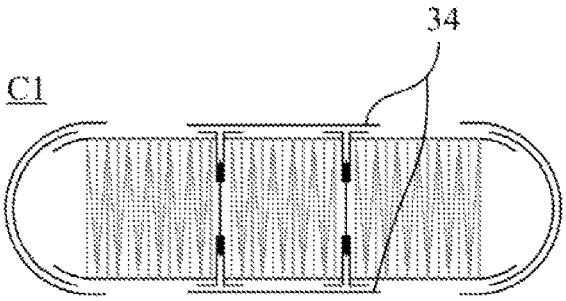
FIG. 12*a* is a schematic cross-sectional view of an example embodiment C1 taken along a line C-C in FIG. 11.
Figure 12B:
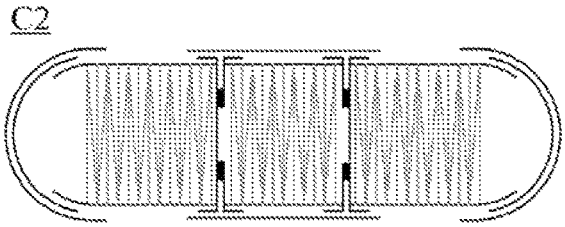
FIG. 12*b* is a schematic cross-sectional view of another example embodiment C2 taken along the line C-C in FIG. 11.
Figure 13:
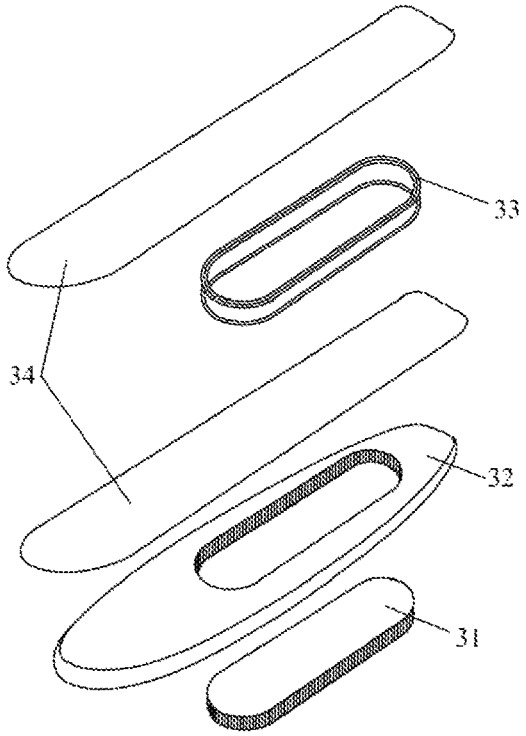
FIG. 13 is an exploded schematic view of a surfboard according to example embodiment C1 or C2.
Figure 14A:
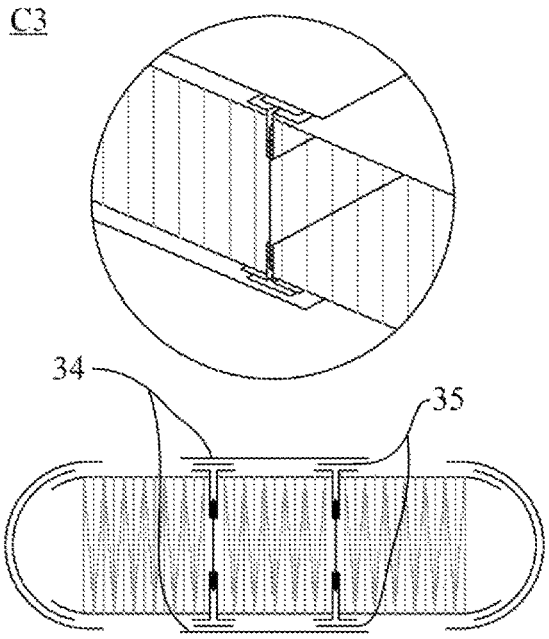
FIG. 14*a* is a schematic cross-sectional view, including an enlarged schematic view, of a further example embodiment C3 taken along the line C-C in FIG. 11.
Figure 14B:
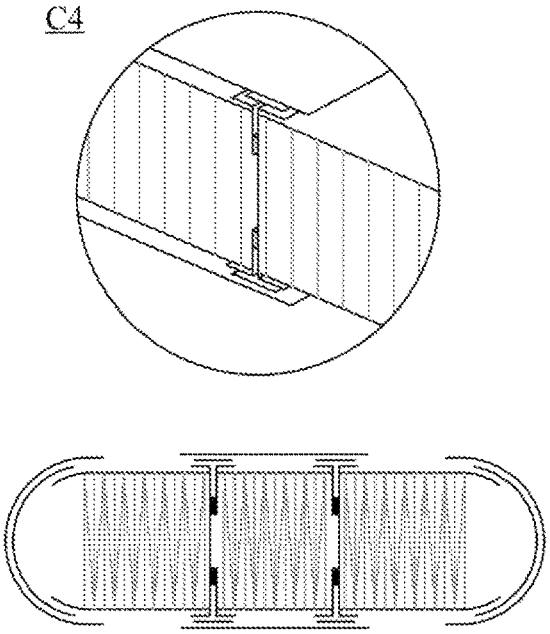
FIG. 14*b* is a schematic cross-sectional view, including an enlarged schematic view, of yet a further example embodiment C4 taken along the line C-C in FIG. 11.
Figure 15:
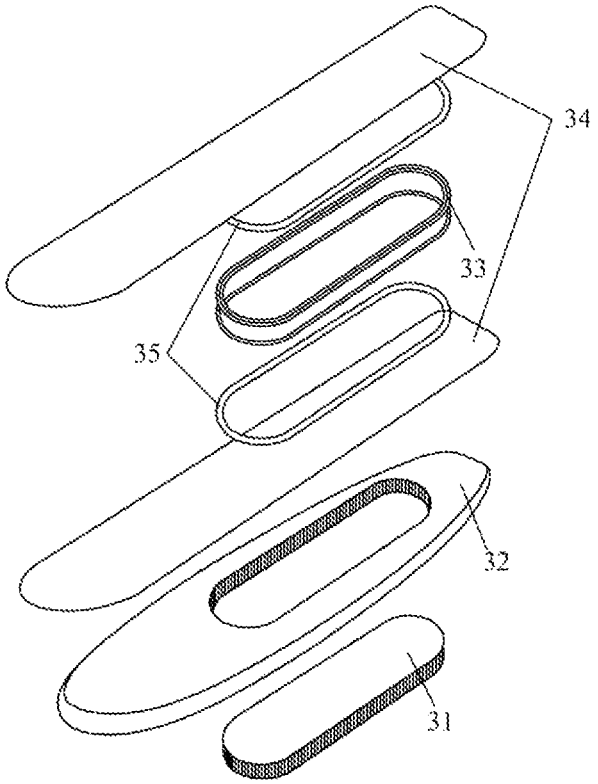
FIG. 15 is an exploded schematic view of a surfboard according to example embodiment C3 or C4.

FIGS. 11 to 15 show a surfboard 3 of a further example embodiment, the surfboard 3 also having a double-air-chamber structure. In the drawings, FIGS. 12*a*, 12*b*, 14*a* and 14*b* are cross-sectional views of different example embodiments C1 to C4, respectively, of the section of the surfboard 3 taken along a line C-C. FIGS. 12*a* to 13 show a surfboard having a reinforcing piece 34, and FIGS. 14*a* to 15 show a surfboard having a reinforcing piece 34 and an auxiliary reinforcing piece 35. The difference between the reinforcing piece 34 and the reinforcing piece 24 of the above example embodiment is that the reinforcing piece 34 of this example embodiment is substantially planar and may cover not only the partition 33 and the first air chamber 31, but also the second air chamber 32 of the surfboard 3. The auxiliary reinforcing piece 35 is arranged between the reinforcing piece 34 and the partition 33, and the auxiliary reinforcing piece 35 may be configured similarly to the auxiliary reinforcing piece 15 of the example shown in FIGS. 4 to 5. The partition 33 may be analogous to the partition 13, such as that shown in FIGS. 12*a*, 12*b*, 14*a* and 14*b*.

According to an example embodiment, one or both of the reinforcing piece and the auxiliary reinforcing piece may be suitable to be connected to another piece via high-frequency welding, hot melting or gluing. The annular reinforcing piece 14, the annular auxiliary reinforcing piece 15, the annular auxiliary reinforcing piece 25, and the annular auxiliary reinforcing piece 35, may each be connected by means of high-frequency welding, hot melting, gluing, and/or another method, and the planar reinforcing piece 24 and the through planar reinforcing piece 34 may be connected by means of gluing or another method.

A double-air chamber surfboard, including a reinforcing piece and/or an auxiliary reinforcing piece, may be manufactured as described below.

According to an example embodiment of a manufacturing method, the reinforcing piece and/or the auxiliary reinforcing piece may be connected such that at least the first connecting portion and the second connecting portion are covered, thereby providing further connection between the first air chamber and the second air chamber.

As shown in FIG. 1, the surfboard 1 may also be further provided with an anti-slip layer 16 which may form an outer surface of the surfboard 1. The anti-slip layer 16 may be arranged on an outer side of the reinforcing piece 14.

An example manufacturing method of the double-air-chamber surfboard may further comprise arranging one or more other safety assistance accessories, such as the anti-slip layer.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. A surfboard, comprising:

a first air chamber and a second air chamber; and a partition arranged between the first air chamber and the second air chamber, the partition comprising:

a first connecting portion connected to a top wall of the first air chamber and to a top wall of the second air chamber, the first connecting portion comprising two top wall connecting pieces, each of the two top wall connecting pieces comprising an extension piece extending between the first air chamber and the second air chamber;

a second connecting portion connected to a bottom wall of the first air chamber and to a bottom wall of the second air chamber, the second connecting portion comprising two bottom wall connecting pieces, each of the two bottom wall connecting pieces comprising an extension piece extending between the first air chamber and the second air chamber; and an intermediate portion extending between the first connecting portion and the second connecting portion;

wherein:

a first end of the intermediate portion is integrally formed with one of the extension pieces of the two top wall connecting pieces and is connected to the other extension piece of the two top wall connecting pieces; and/or a second end of the intermediate portion is integrally formed with one of the extension pieces of the two bottom wall connecting pieces and is connected to the other extension piece of the two bottom wall connecting pieces.

2. The surfboard according to claim 1, wherein the first air chamber comprises a first air valve, and the second air chamber comprises a second air valve.

3. The surfboard according to claim 1, wherein each of the first air chamber and the second air chamber comprises a drop-stitch material.

4. The surfboard according to claim 1, wherein:

the first end of the intermediate portion is connected to the one extension piece of the two top wall connecting pieces by at least one of high-frequency welding, hot melting, and gluing; and/or the second end of the intermediate portion is connected to the other extension piece of the two bottom wall connecting pieces by at least one of high-frequency welding, hot melting, and gluing.

5. The surfboard according to claim 4, wherein both ends of the intermediate portion are integrally formed with the extension piece of one of the two top wall connecting pieces of the first connecting portion and the extension piece of one of the two bottom wall connecting pieces of the second connecting portion on a same side of the first connecting portion and the second connecting portion, respectively.

6. The surfboard according to claim 4, wherein respective ends of the intermediate portion are integrally formed with the extension piece of one of the two top wall connecting pieces of the first connecting portion and the extension piece of one of the two bottom wall connecting pieces of the second connecting portion on the opposite sides of the first connecting portion and the second connecting portion, respectively.

7. The surfboard according to claim 1, further comprising an auxiliary reinforcing piece configured to be arranged between a reinforcing piece and one of the first connecting portion and the second connecting portion, the auxiliary reinforcing piece covering the one of the first connecting portion and the second connecting portion.

8. The surfboard according to claim 7, wherein the auxiliary reinforcing piece covers a gap between at least one of:

the two top wall connecting pieces of the first connecting portion; and the two bottom wall connecting pieces of the second connecting portion.

9. The surfboard according to claim 7, wherein the reinforcing piece is disposed on and covers the auxiliary reinforcing piece and one of the first connecting portion and the second connecting portion.

10. The surfboard according to claim 1 wherein:

the first end of the intermediate portion is integrally formed with the extension piece of one of the two top wall connecting pieces, and the second end of the intermediate portion is sandwiched between the opposite two bottom wall connecting pieces; or the first end of the intermediate portion is integrally formed with the extension piece of one of the two bottom wall connecting pieces, and the second end of the intermediate portion is sandwiched between the opposite two top wall extension pieces.

11. The surfboard of claim 1, wherein the intermediate portion is formed from a single piece of material.

12. A surfboard, comprising:

a first air chamber and a second air chamber; and a partition arranged between the first air chamber and the second air chamber, the partition comprising:

a first connecting portion connected to a top wall of the first air chamber and to a top wall of the second air chamber, the first connecting portion comprising two top wall connecting pieces, each of the two top wall connecting pieces comprising an extension piece extending between the first air chamber and the second air chamber;

a second connecting portion connected to a bottom wall of the first air chamber and to a bottom wall of the second air chamber, the second connecting portion comprising two bottom wall connecting pieces, each of the two bottom wall connecting pieces comprising an extension piece extending between the first air chamber and the second air chamber;

an intermediate portion extending between the first connecting portion and the second connecting portion; and wherein:

the second air chamber is arranged around the first air chamber; and a first end of the intermediate portion is integrally formed with one of the extension pieces of the two top wall connecting pieces and is connected to the other extension piece of the two top wall connecting pieces; and/or a second end of the intermediate portion is integrally formed with one of the extension pieces of the two bottom wall connecting pieces and is connected to the other extension piece of the two bottom wall connecting pieces.

13. The surfboard according to claim 12, further comprising an auxiliary reinforcing piece configured to be arranged between a reinforcing piece and one of the first connecting portion and the second connecting portion, the auxiliary reinforcing piece surrounding and covering the one of the first connecting portion and the second connecting portion.

14. The surfboard according to claim 13, wherein the auxiliary reinforcing piece is arranged between the reinforcing piece and the one of the first connecting portion and the second connecting portion.

15. The surfboard according to claim 14, wherein at least one of the reinforcing piece and the auxiliary reinforcing piece is connected to another element by at least one of high-frequency welding, hot melting, and gluing.

16. The surfboard according to claim 13, wherein the reinforcing piece is disposed on and covers one of the first connecting portion and the second connecting portion.

17. The surfboard according to claim 13, wherein the auxiliary reinforcing piece comprises an annular auxiliary reinforcing piece.

18. The surfboard according to claim 17, wherein the reinforcing piece comprises an annular reinforcing piece surrounding and covering the auxiliary reinforcing piece and the one of the first connecting portion and the second connecting portion.

19. The surfboard according to claim 13, wherein the auxiliary reinforcing piece covers a gap between at least one of:

two top wall connecting pieces of the first connecting portion; and two bottom wall connecting pieces of the second connecting portion.

20. The surfboard according to claim 12, wherein the first end of the intermediate portion is integrally formed with the extension piece of one of the two top wall connecting pieces of the first connecting portion and the second end of the intermediate portion is integrally formed with the extension piece of one of the two bottom wall connecting pieces of the second connecting portion.

21. The surfboard according to claim 20, wherein both ends of the intermediate portion are integrally formed with the extension piece of one of the two top wall connecting pieces of the first connecting portion and the extension piece of one of the two bottom wall connecting pieces of the second connecting portion on a same side of the first connecting portion and the second connecting portion, respectively.

22. The surfboard according to claim 20, wherein respective ends of the intermediate portion are integrally formed with the extension piece of one of the two top wall connecting pieces of the first connecting portion and the extension piece of one of the two bottom wall connecting pieces of the second connecting portion on the opposite sides of the first connecting portion and the second connecting portion, respectively.

23. The surfboard according to claim 12 wherein:

the first end of the intermediate portion is integrally formed with the extension piece of one of the two top wall connecting pieces, and the second end of the intermediate portion is sandwiched between the opposite two bottom wall connecting pieces; or the first end of the intermediate portion is integrally formed with the extension piece of one of the two bottom wall connecting pieces, and the second end of the intermediate portion is sandwiched between the opposite two top wall extension pieces.

24. The surfboard of claim 12, wherein the intermediate portion is formed from a single piece of material.

25. An inflatable device comprising:

a first air chamber partially enclosed by a first top wall and a first bottom wall;

a second air chamber partially enclosed by a second top wall and a second bottom wall; and a partition arranged between the first air chamber and the second air chamber, the partition comprising:

a first connecting portion connected to the first top wall and the second top wall, the first connecting portion comprising two top wall connecting pieces, each of the two top wall connecting pieces comprising an extension piece extending between the first air chamber and the second air chamber;

a second connecting portion connected to the first bottom wall and the second bottom wall, the second connecting portion comprising two bottom wall connecting pieces, each of the two bottom wall connecting pieces comprising an extension piece extending between the first air chamber and the second air chamber;

an intermediate portion extending between the first connecting portion and the second connecting portion; and wherein:

a first end of the intermediate portion is integrally formed with one of the extension pieces of the two top wall connecting pieces and is connected to the other extension piece of the two top wall connecting pieces; and/or a second end of the intermediate portion is integrally formed with one of the extension pieces of the two bottom wall connecting pieces and is connected to the other extension piece of the two bottom wall connecting pieces.

26. The inflatable device according to claim 25, further comprising:

a top reinforcing piece disposed on the first connecting portion;

a bottom reinforcing piece disposed on the second connecting portion;

an auxiliary top reinforcing piece disposed between the top reinforcing piece and the first connecting portion; and an auxiliary bottom reinforcing piece disposed between the bottom reinforcing piece and the second connecting portion.

27. The inflatable device according to claim 26, wherein:

the top reinforcing piece is disposed on and covers an entirety of the first top wall and at least a portion of the second top wall; and the bottom reinforcing piece is disposed on and covers an entirety of the first bottom wall and at least a portion of the second bottom wall.

28. The inflatable device according to claim 26, wherein:

the auxiliary top reinforcing piece is disposed on and covers at least a portion of the first top wall and an entirety of the second top wall; and the auxiliary bottom reinforcing piece is disposed on and covers at least a portion of the first bottom wall and an entirety of the second bottom wall.

29. The inflatable device according to claim 26, wherein:

the first connecting portion comprises the two top wall connecting pieces respectively connected to the first top wall and the second top wall;

the second connecting portion comprises the two bottom wall connecting pieces respectively connected to the first bottom wall and the second bottom wall.

30. The inflatable device according to claim 26, wherein:

the first connecting portion comprises the two top wall connecting pieces respectively connected to the first top wall and the second top wall;

the second connecting portion comprises the two bottom wall connecting pieces respectively connected to the first bottom wall and the second bottom wall; and the auxiliary reinforcing piece covers a gap between at least one of:

the two top wall connecting pieces of the first connecting portion; and the two bottom wall connecting pieces of the second connecting portion.

31. The inflatable device according to claim 25, wherein:

the first end of the intermediate portion is connected to the one extension piece of the two top wall connecting pieces by at least one of high-frequency welding, hot melting, and gluing; and/or the second end of the intermediate portion is connected to the other extension piece of the two bottom wall connecting pieces by at least one of high-frequency welding, hot melting, and gluing.

32. The inflatable device according to claim 31, wherein both ends of the intermediate portion are integrally formed with the extension piece of one of the two top wall connecting pieces of the first connecting portion and the extension piece of one of the two bottom wall connecting pieces of the second connecting portion on a same side of the first connecting portion and the second connecting portion, respectively.

33. The inflatable device according to claim 31, wherein respective ends of the intermediate portion are integrally formed with the extension piece of one of the two top wall connecting pieces of the first connecting portion and the extension piece of one of the two bottom wall connecting pieces of the second connecting portion on the opposite sides of the first connecting portion and the second connecting portion, respectively.

34. The inflatable device according to claim 25 wherein:

the first end of the intermediate portion is integrally formed with the extension piece of one of the top wall connecting pieces, and the second end of the intermediate portion is sandwiched between the opposite two bottom wall connecting pieces; or the first end of the intermediate portion is integrally formed with the extension piece of one of the two bottom wall connecting pieces, and the second end of the intermediate portion is sandwiched between the opposite two top wall extension pieces.

35. The inflatable device of claim 25, wherein the intermediate portion is formed from a single piece of material.

36. The surfboard according to claim 12, wherein each of the first air chamber and the second air chamber comprises a drop-stitch material.

37. The surfboard according to claim 25, wherein each of the first air chamber and the second air chamber comprises a drop-stitch material.

* * * * *